US005855766A

United States Patent [19]

Mamiye et al.

[11] Patent Number: 5,855,766

[45] Date of Patent: Jan. 5, 1999

[54] ARTICLE RECEPTACLE FRAME MEMBER

[76] Inventors: Marc Mamiye, 16 Miro Cir., Marlboro, N.J. 07746; Eli Mamiye, 9 Harbor Ct., West Long Branch, N.J. 07764

[21] Appl. No.: 660,820

[22] Filed: Jun. 10, 1996

[51] Int. Cl.[6] ..... B65D 25/00

[52] U.S. Cl. ..... 206/581; 150/120; 190/122

[58] Field of Search ..... 206/525, 581; 220/4.21, 4.24, 4.25, 4.26, 4.27, 784, 786, 642, 643, 640; 150/120, 123, 124, 125, 126; 190/121, 122, 123

[56] References Cited

U.S. PATENT DOCUMENTS

| | | | |
|---|---|---|---|
| 2,609,854 | 9/1952 | Rosen | 150/126 X |
| 5,211,302 | 5/1993 | Tiramani | 220/4.25 |
| 5,265,749 | 11/1993 | Zutler | 220/4.25 X |

*Primary Examiner*—Jacob K. Ackun

[57] ABSTRACT

A frame member for an article receptacle includes an annular member having formed thereon a protruding member and a recess or notch for receiving the protruding member of an identical frame. The protruding member and the recess or notch are disposed opposite to one another on the annular member. Also described is an article receptacle made with two such frame members.

11 Claims, 5 Drawing Sheets

ARTICLE RECEPTACLE FRAME MEMBER

RELATED APPLICATIONS

Marc Mamiye is the record owner of co-pending U.S. patent application Ser. No. 08/624,966 entitled CONTOURED FOAM ARTICLE RECEPTACLE AND METHOD FOR MAKING SAME which was filed in the U.S. Patent Office on Mar. 28, 1996 by his attorney of record, Jean-Marc Zimmerman, Esq., Registration No. 36,978.

FIELD OF THE INVENTION

The present invention relates generally to article receptacles and to other articles of manufacture which include a frame, and more specifically to a frame member for such article receptacles and/or other articles, and a method for manufacturing the same.

BACKGROUND OF THE INVENTION

The prior art is replete with various types of article receptacles and other articles of manufacture which include a frame. These articles of manufacture include compacts for mirrors and/or cosmetics, as well as article receptacles designed for carrying different types of items such as eyeglasses, pens, watches, rings, etc. Other article receptacles are designed as packaging receptacles for items such as computers, telephones, stereo equipment and the like. Still, other article receptacles are constructed as purses or hand bags. Some of these hand bags include hand straps, shoulder straps or waist straps, while others are simply intended to be hand carried without the use of a strap.

Article Receptacles constructed as purses and/or hand bags, are typically manufactured using natural and synthetic materials such as vinyl, leather, fabric, plastic and cardboard. Many of these article receptacles consist of two separate sections. In some designs, the two sections form the cover and base members of the article receptacle. In other designs, the two sections form tile side members of the article receptacle. Such article receptacles employ separately attached frame members along the opening edge of each article receptacle section. Generally, the frame members are placed along the opening edge of the article receptacle section for a variety of purposes. For example, the frame members serve as an ornamental trim to enhance the visual appeal of the article receptacle. The frame members also reinforce and strengthen the edge of the article receptacle section to help maintain its shape and to protect the edge of the article receptacle section from damage. Further, the frame members enable the article receptacle sections to be hinged to each other via hinges which are attached to each frame member. Still further, closures such as buckles, clasps, etc. for locking the article carrier sections closed can be attached to the frame members. Additionally, the frame members provide a location for attaching shoulder and hand straps to the article receptacle.

Prior art frame member designs generally include a male member for one of the two article receptacle sections and a female member for the other one of the two article receptacle sections. The male and female frame member arrangement is necessitated by the design of the hinges, clasps, etc. employed to enable the article receptacle to open and close. In particular, the hinge and/or clasp used in prior art designs typically include differently configured elements on each frame member. Thus, two separate molds must be employed for forming each of the two respective frame members, which increases the cost of fabricating the article receptacle.

Accordingly, a need exists for an article receptacle having frame members including a hinge, a clasp and other likes elements, wherein the frame members can be manufactured in and from a single mold having a single cavity.

SUMMARY OF THE INVENTION

In accordance with the present invention, there is provided a frame member for an article receptacle comprising an annular member having formed thereon a protruding member and means for receiving the protruding member of a substantially identical frame member. The protruding member and the means for receiving are disposed opposite to one another on the annular member.

Also in accordance with the present invention is an article receptacle made with two frame members as described above.

DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1C:
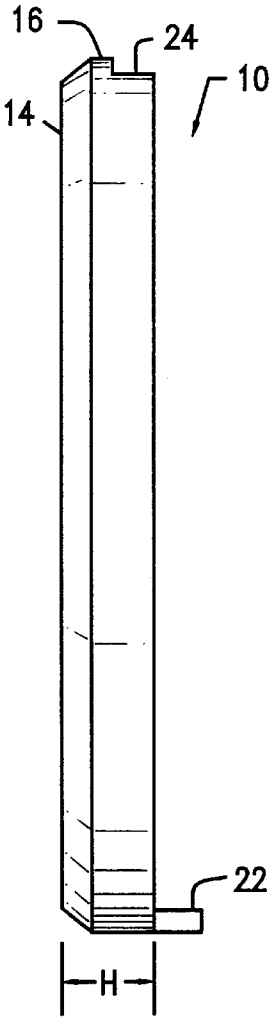
FIG. 1C is a side view of the frame member of FIGS. 1A and 1B.
Figure 1A:
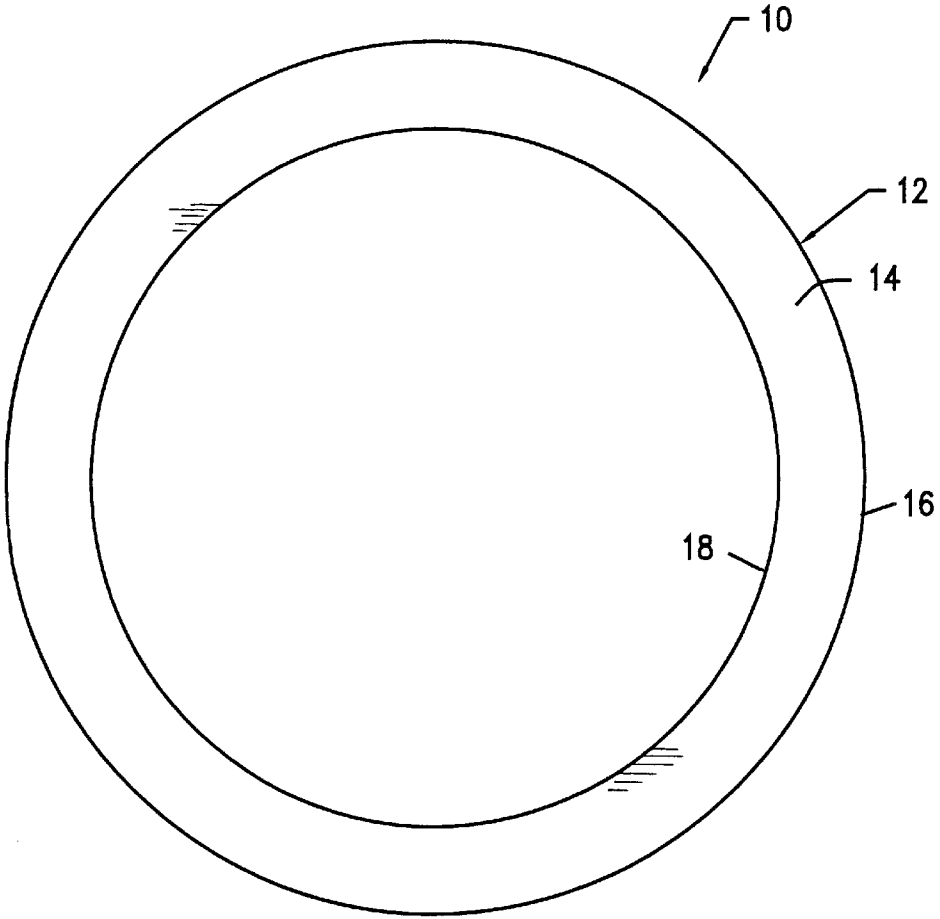
FIG. 1A is a top view of a frame member according to a first embodiment of the present invention.
Figure 1B:
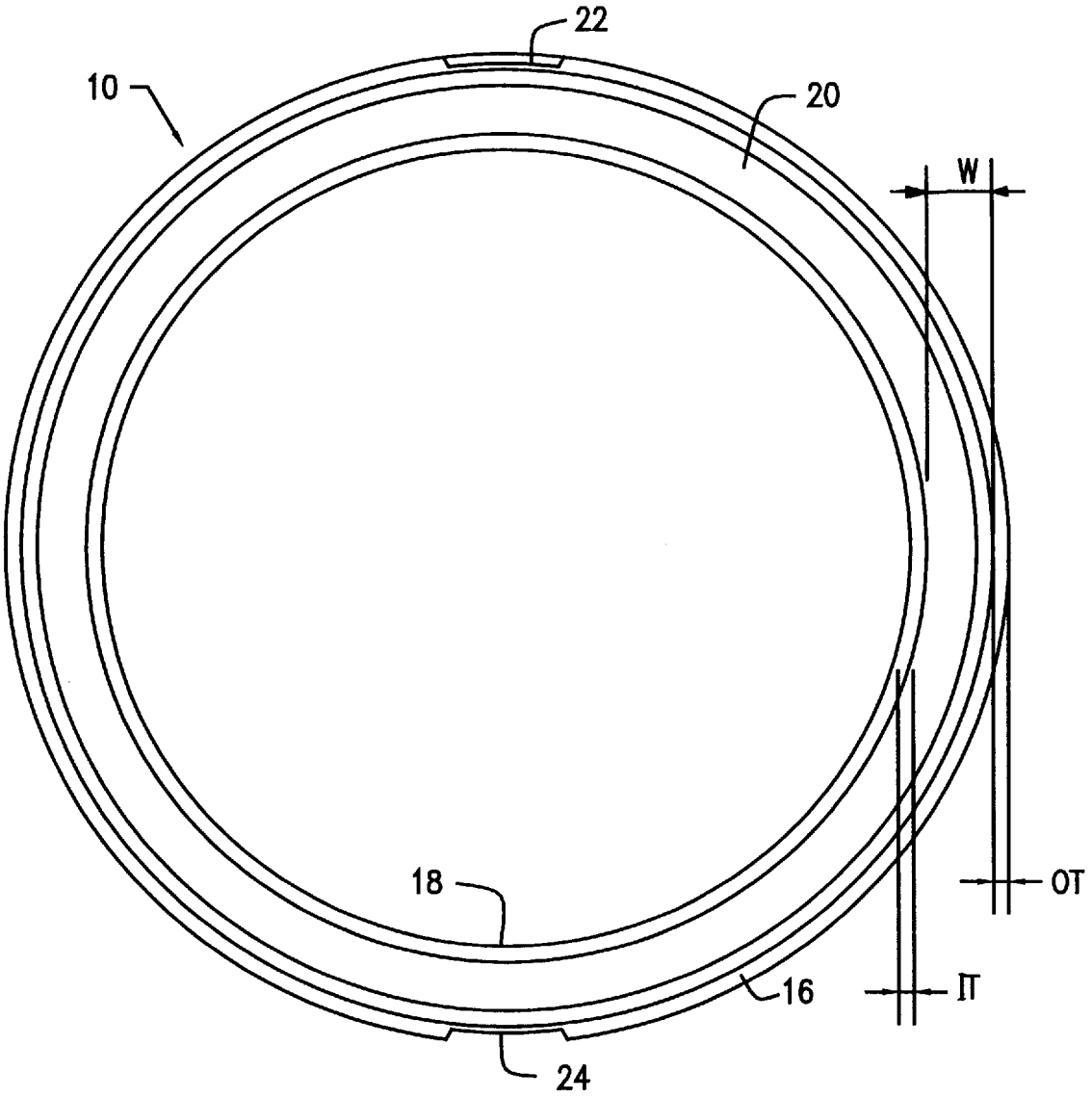
FIG. 1B is a bottom view of the frame member of FIG. 1A.

Referring to FIGS. 1A–1C, an illustrative embodiment of a frame member 10 of the present invention is shown. As can be seen, the frame member 10 generally comprises an metal annular member 12. It should be understood, however, that the frame member 10 may also be rectangular, square, or any other desirable shape as well. Further, the frame member can be made from other suitable materials such as plastic, etc.

As shown in the top view of FIG. 1A, the annular member 12 includes an endwall 14. In the bottom view of FIG. 1B, the annular member 12 includes an outer sidewall 16 and an inner sidewall 18 concentrically spaced from the outer sidewall 16. The outer and inner sidewalls 16 and 18 depend from the bottom surface of the endwall 14 and define a circular-shaped groove or panel cavity 20 therebetween for receiving the panel edge of an article receptacle section.

As shown in FIGS. 1B and 1C, the outer sidewall 16 of the annular member 12 includes a tongue member 22. The outer sidewall 16 also includes a notch 24 disposed approximately 180 degrees opposite from the tongue member 22. The notch is sized slightly larger than the tongue member 22 as will be explained.

The frame member 10 of the present invention can be dimensioned such that the outer sidewall 16 has a thickness OT of approximately 1/8 inches, the inner sidewall 18 has a thickness IT of approximately 1/16 inches, the panel cavity has a width W of approximately 3/16 inches, and the outer sidewall 16 has a height H of approximately 5/16 inches. It should be understood, however, that the frame member of the present invention is not limited to any particular dimensions and can be dimensioned as desired depending upon the particular application.

Figure 2:
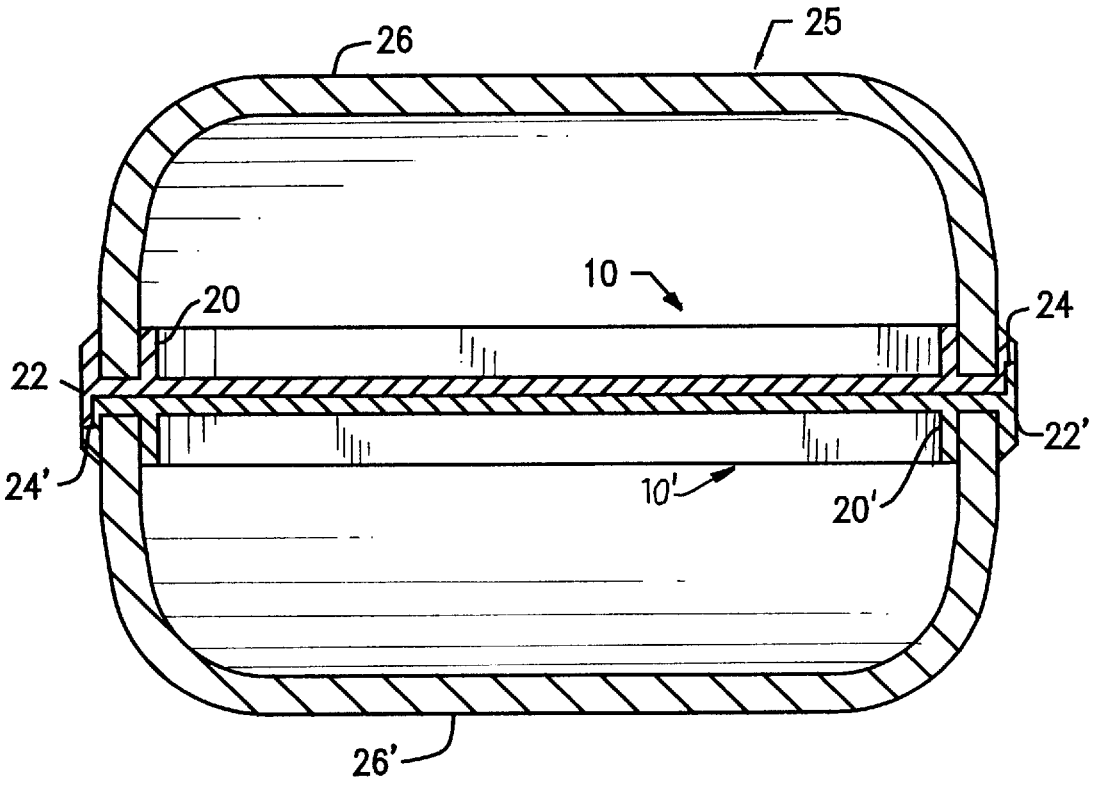
FIG. 2 is a cross-sectional view of an article receptacle manufactured with two frame members each substantially like the one shown in FIGS. 1A–1C.

Referring to FIG. 2, the opposing tongue and notch arrangement described above allows identical frame members 10 and 10' to be employed on the article receptacle sections 26 and 26' of an article receptacle 25 such as an evening bag. The article receptacle sections 26 and 26' can be of the type described in the earlier mentioned related copending application entitled CONTOURED FOAM ARTICLE RECEPTACLE AND METHOD FOR MAKING SAME. In any case, the use of the frame members 10 and 10' as shown is possible because the frame members 10 and 10' are essentially mirror images of each other. As shown, the tongue member 22 of frame member 10 is received by the notch 24' of frame member 10'. Similarly, the tongue member 22' is received by the notch 24 of frame member 10.

Accordingly, the frame member of the present invention advantageously allows the use of a single manufacturing mold since the same frame member can be used for both frames of the article receptacle. Thus, tooling costs can be reduced by approximately 50%. Further, closures, interlocking hinge elements, eyes for hand, shoulder or waist straps, etc. are all created simultaneously without having to spot weld or otherwise manipulate said frame in order to add such elements in a later fabrication step.

As also shown in FIG. 2, the grooves or panel cavities 20 and 20' each receive the peripheral edges of associated article receptacle sections 26 and 26'. Any well known adhesive or other like means can be used to ensure that the peripheral edges of the article receptacle sections remain in the grooves 20 and 20' of the frames 10 and 10', respectively.

Referring to FIGS. 3A–3E there is shown a second embodiment of the present invention. The frame 30 is similar to the one shown in FIGS. 1A–1C and therefore, includes an annular member 32 having an endwall 34, an outer sidewall 36 and an inner sidewall 38. The frame 30 differs from the previous embodiment in that the endwall 34 includes a protruding male member 40 and an oppositely disposed recessed female member 42. The frame member 30 also includes a triangular-shaped flange 44 with an eye 46 defined therein for enabling the attachment of hand, shoulder, or waist strap. The flange 44 extends from the endwall 34. A hinge element 48 also extends from the endwall 34 at a location on the annular member 32 which is approximately midway between the male member 40 and the female member 42. A bent shaped clasp member 50 is disposed opposite to the hinge element 48 on the outer sidewall 36.

Figure 3D:
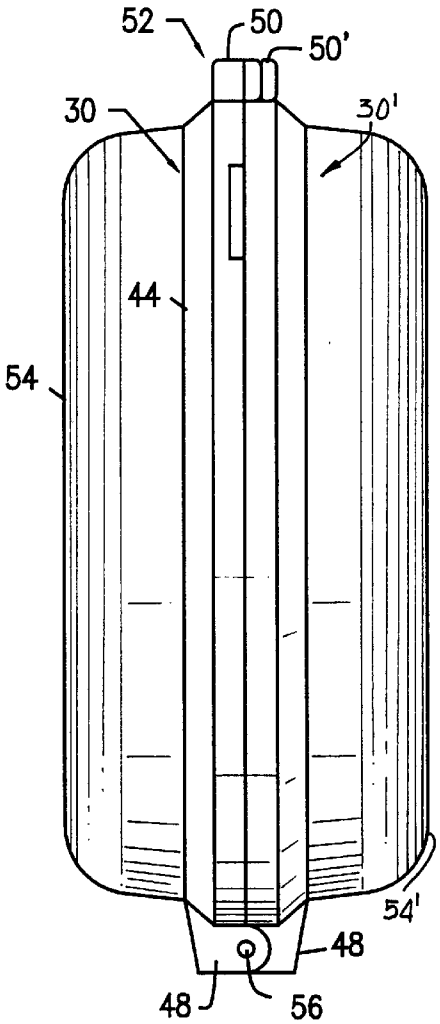
FIG. 3D is a side view of an article receptacle manufactured with two frame members each substantially like the one shown in FIGS. 3A–3C.
Figure 3C:
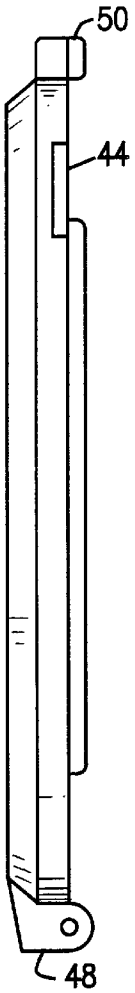
FIG. 3C is a side view of the frame member of FIGS. 3A and 3B.
Figure 3A:
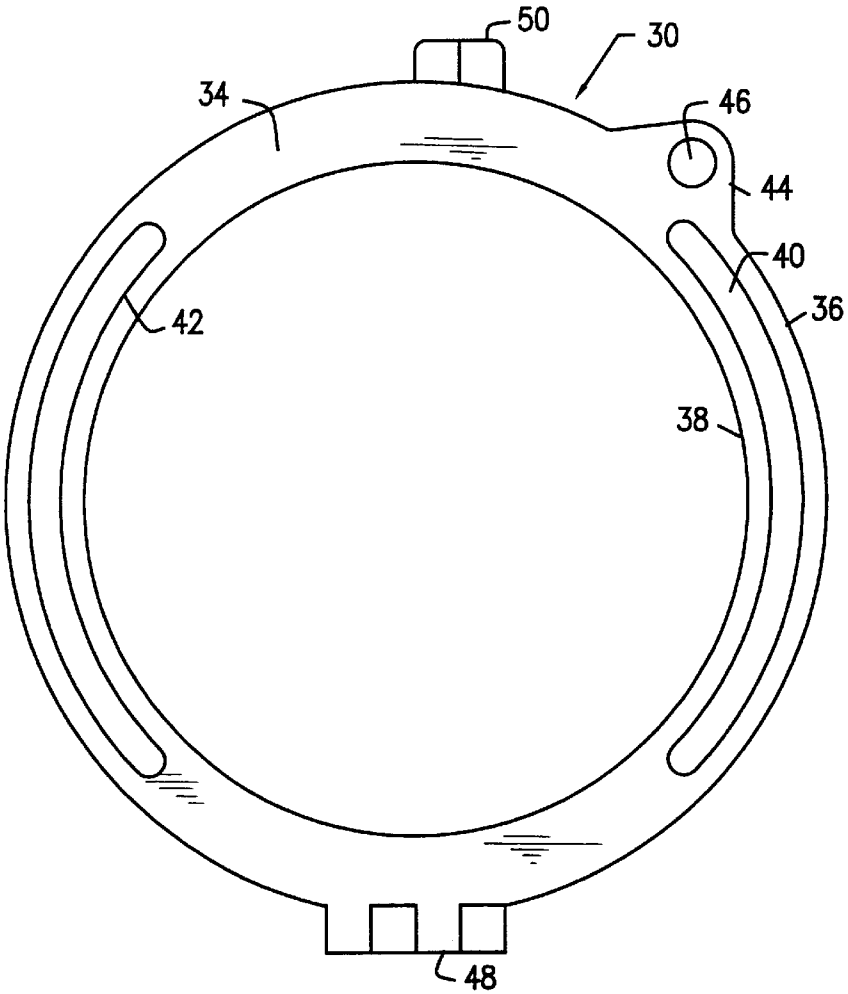
FIG. 3A is a top view of a frame member according to a second embodiment of the present invention.
Figure 3E:
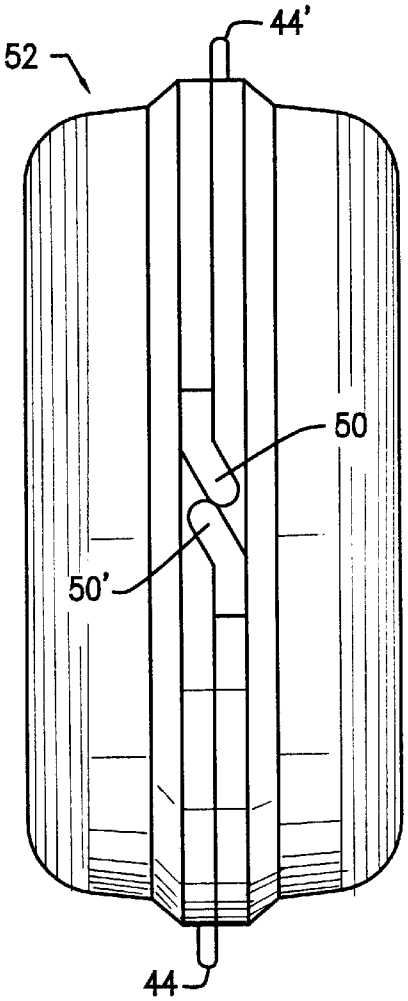
FIG. 3E is a side view of the article receptacle of FIG. 3E rotated 90 degrees.
Figure 3B:
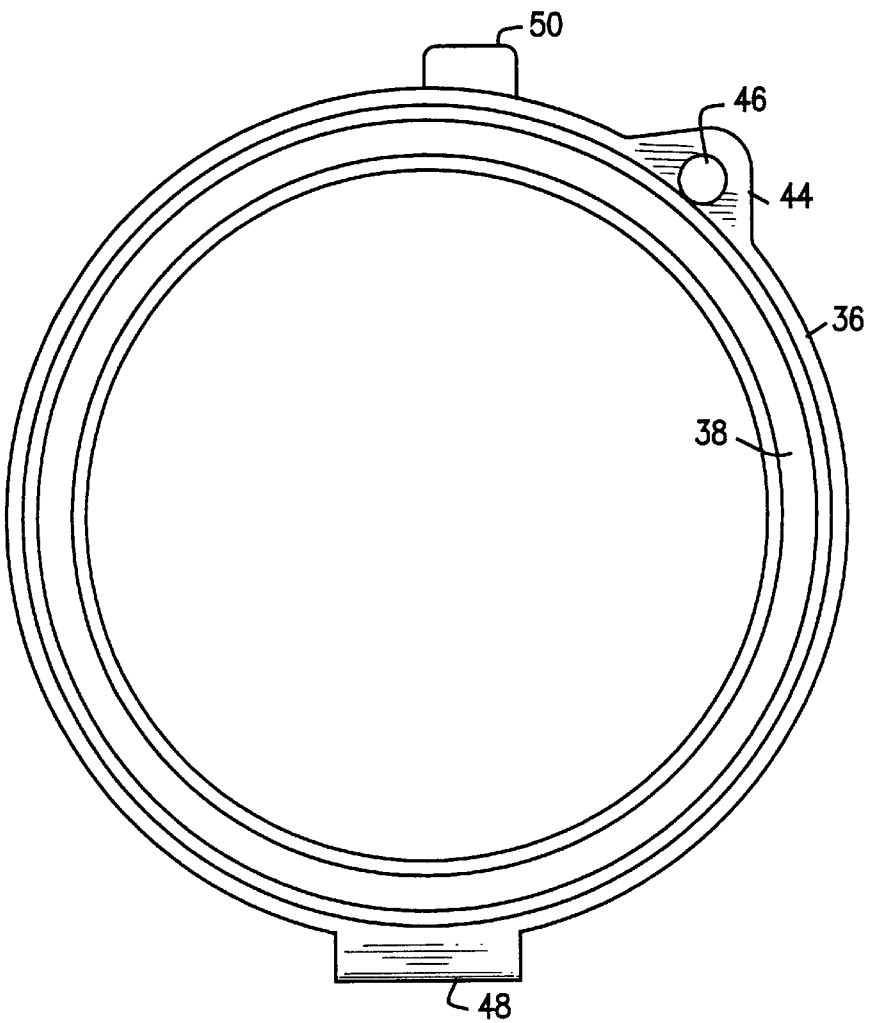
FIG. 3B is a bottom view of the frame member of FIG. 3A.

Like the opposing tongue and notch arrangement described above in the first embodiment, the opposing male and female member arrangement of the second embodiment of the present invention allows identical frame members 30 and 30' to be employed on the article receptacle sections 54 and 54' of an article receptacle 52 since the frame members 30 and 30' are essentially mirror images of each other as shown in FIGS. 3D and 3E. Accordingly, the male member 40 of frame member 30 fits into the female member 42' of frame member 30'. Similarly, the male member 40' fits into the female member 42 of frame member 30 thereby allowing the endwalls of the frame members to fit flush against each other when the article receptacle 52 is closed. Further, the hinge elements 48 and 48' interlock with each other to enable the article receptacle sections 54 and 54' to pivot relative to each via a hinge pin 56. As can be seen in FIG. 3E, the flanges 44 and 44' are arranged opposite to each other when the frame members 30 and 30' are fitted together. On the other hand, the clasp members 50 and 50' are arranged as shown such that they operate as a clasp-type closure for the article receptacle 52.

Accordingly, numerous modifications and alternative embodiments of the invention will be apparent to those skilled in the art in view of the foregoing descriptions. Hence, these descriptions are to be construed as illustrative only and for the purpose of teaching those skilled in the art the best mode of carrying out the invention. Details of the structure may be varied substantially without departing from the spirit of the invention and the exclusive use of all modifications which come within the scope of the appended claims is reserved.

What is claimed is:

1. An article receptacle, comprising:

a first section having a peripheral edge;

a second section having a peripheral edge; and a pair of frames, one of said frames affixed to said peripheral edge of said first section and the other of said frames affixed to said peripheral edge of said second section, each of said frames including a protruding member and means for receiving a protruding member of the other frame, wherein upon the placing of said first and second sections in a first closed position, said protruding member of said one frame is received by said receiving means of said other frame and said protruding member of said other frame is received by said means for receiving of said one frame.

2. The article receptacle according to claim 1, wherein said means for receiving of each of said frames is disposed opposite to said protruding member on said annular members.

3. The article receptacle according to claim 1, wherein each of said annular members includes an endwall.

4. The article receptacle according to claim 3, wherein each of said annular members includes a sidewall extending from said end wall.

5. The article receptacle according to claim 4, wherein each of said annular members includes a second sidewall concentrically spaced from said sidewall.

6. The article receptacle according to claim 5, wherein said sidewalls define a circularly-shaped groove therebetween for receiving said peripheral edge of an associated section of said article receptacle.

7. The article receptacle according to claim 5, wherein said protruding member and said means for receiving are associated with said sidewall.

8. The article receptacle according to claim 5, wherein said protruding member comprises a tongue extending from said sidewall and said means for receiving comprises a notch defined in said sidewall.

9. The article receptacle according to claim 5, wherein said protruding member and said means for receiving are associated with said endwall.

10. The article receptacle according to claim 1, wherein each of said annular members is made from a metallic material.

11. The article receptacle according to claim 1, wherein each of said annular members is made from a plastic material.

* * * * *